United States Patent [19]

Balve

[11] 3,945,348

[45] Mar. 23, 1976

[54] TWO-CHAMBER, TWO-STROKE ROCKING PISTON INTERNAL COMBUSTION ENGINE

[76] Inventor: Robert Balve, Tilsiterstrasse 19, 6641 Hilbringen, Seitert, Germany

[22] Filed: Oct. 16, 1973

[21] Appl. No.: 406,975

[30] Foreign Application Priority Data

Oct. 16, 1973 Luxemburg ..... 66303

[52] U.S. Cl. ..... 123/18 R; 92/120

[51] Int. Cl.[2] ..... F02B 53/06; F02B 53/10

[58] Field of Search ..... 123/18 R, 18 A; 91/23, 91/399; 92/120, 121

[56] References Cited

UNITED STATES PATENTS

| | | | |
|---|---|---|---|
| 1,144,105 | 6/1915 | Brown | 123/18 R |
| 2,127,743 | 8/1938 | Linthwaite | 123/18 R |
| 3,451,382 | 6/1969 | Huff | 123/18 |

FOREIGN PATENTS OR APPLICATIONS

| | | | |
|---|---|---|---|
| 1,367,633 | 6/1964 | France | 123/18 R |
| 32,509 | 12/1910 | Sweden | 123/18 R |
| 301,294 | 11/1928 | United Kingdom | 123/18 R |

*Primary Examiner*—Charles J. Myhre
*Assistant Examiner*—William C. Anderson
*Attorney, Agent, or Firm*—John J. Dennemeyer

[57] ABSTRACT

A two-stroke internal combustion engine which comprises two rocking pistons disposed on opposite sides of a separating element that separates two pump chambers from each other. The pump chambers are located on the back side of the rocking pistons, and a hollow rotary slide is mounted in the separating element to positively control the intake and precompression phases of the pump chambers.

7 Claims, 2 Drawing Figures

TWO-CHAMBER, TWO-STROKE ROCKING PISTON INTERNAL COMBUSTION ENGINE

In the field of the mixture compressing two-stroke internal combustion engines a stagnation has obviously occurred, especially in the production of two-stroke motors for installation in motor vehicles, aircraft, and for other appropriate uses. Their application remains, for the future, limited principally to motor-cycles and small machine aggregates, and two-stroke motors with the usual crank case pump are predominant in this field, where the maximum stroke volume has a value that does not exceed 350 $cm^3$. As is known, the reason for this lies in the control of the scavenging process, which is indeed the main problem for mixture compressing two-stroke internal combustion engines. The fuel scavenging losses increase with increasing stroke volume, and the construction becomes more complicated, resulting in a high specific fuel and oil consumption. If the two-stroke work cycle process is to be realized in a motor with a higher stroke volume, especially for operating with gasoline, and if this process is to be made economical, it is necessary to eliminate the crank case pump utilized until now to obtain a better charge and a better scavenging of the working chambers for the necessary air supply, because with the usual crank case pump the necessary greater air quantities and the necessary increase of the precompression cannot be obtained. The mentioned inconveniences have been eliminated by the provision of a two-chamber, two-stroke rocking piston internal combustion engine, wherein two separate pump chambers working independently of the crank case are arranged in the rocking piston plane, and wherein the fresh-air intake and precompression phases in the pump chambers are positively controlled by means of a hollow rotary slide.

Figure 1:
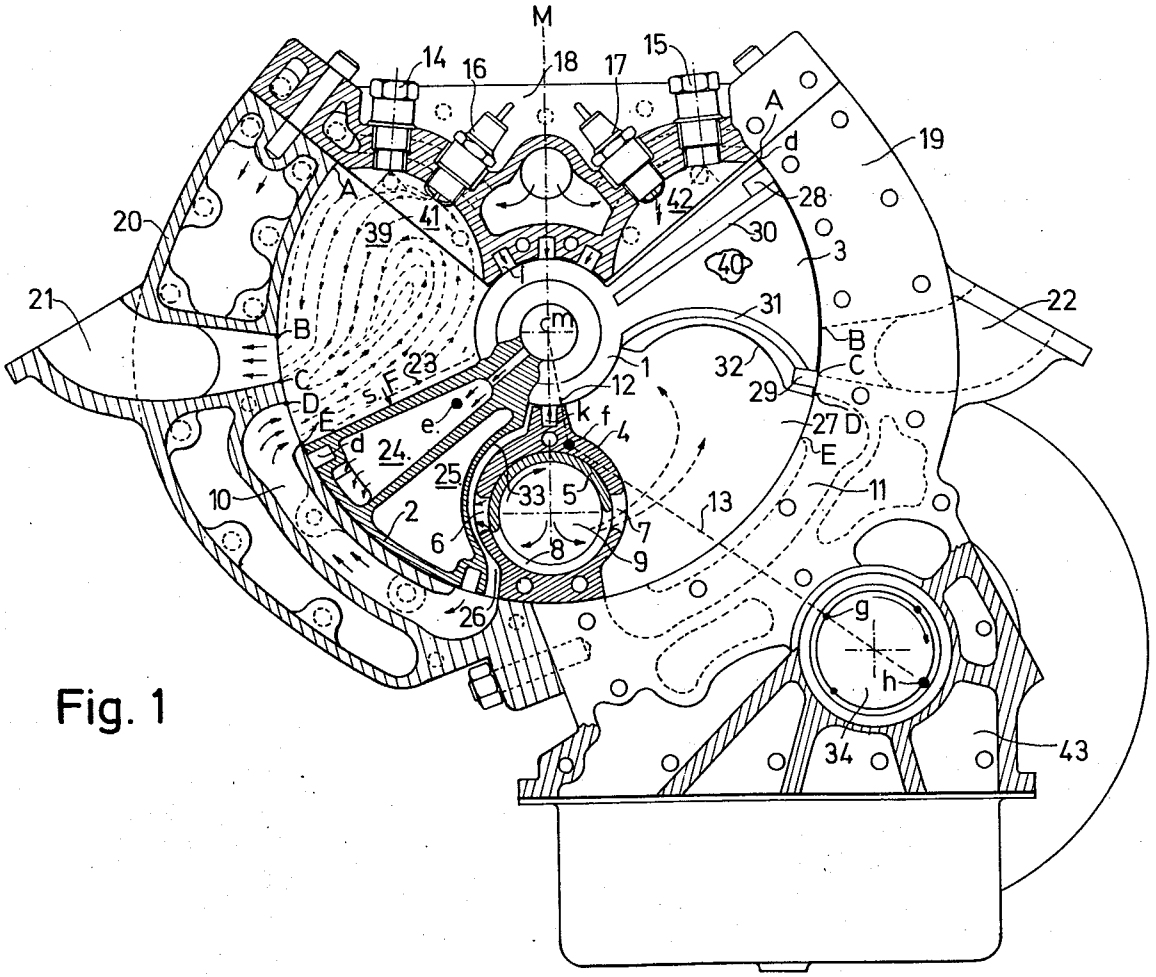
Figure 2:
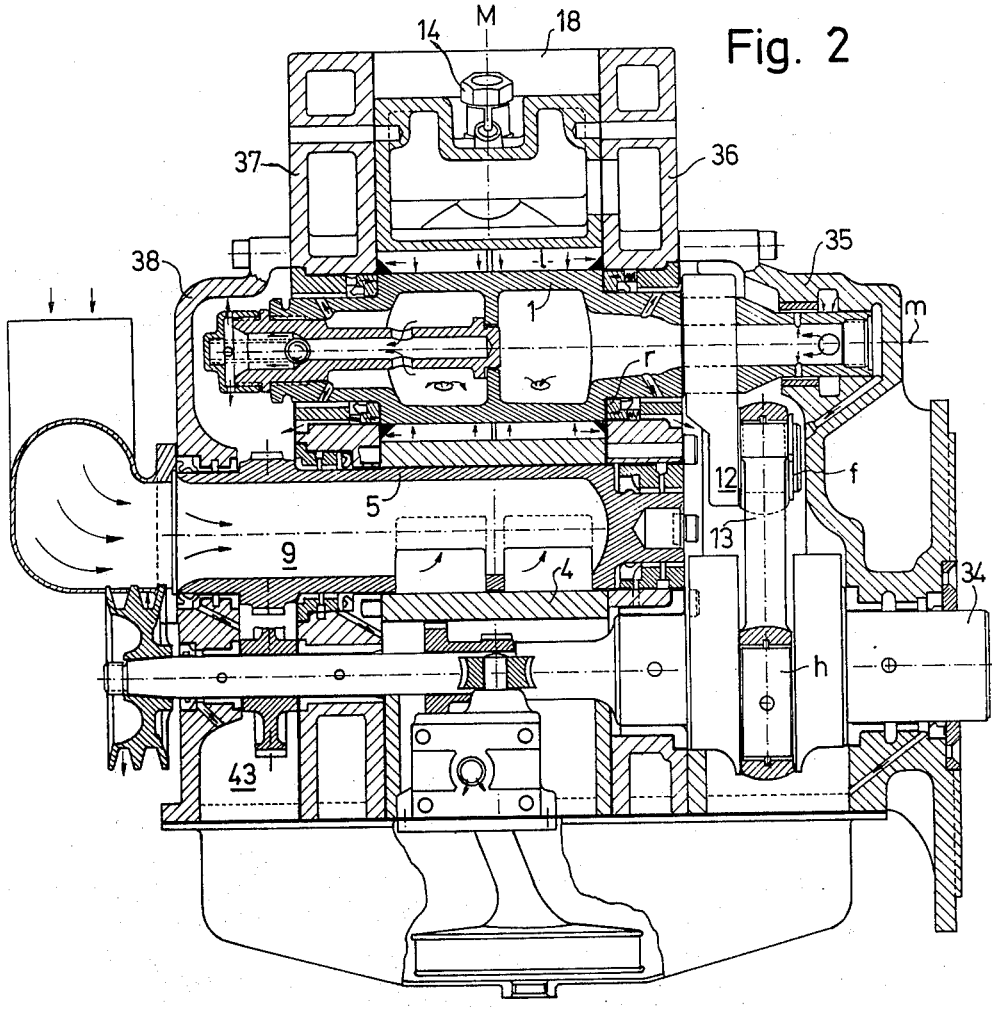

The operating cycle of the two pump chambers and their common hollow rotary slide will be described in greater detail by referring to an example of the two-chamber, two-stroke internal combustion engine shown in the accompanying drawings, wherein:

FIG. 1 is a cross-sectional view of the internal combustion engine according to the invention, and FIG. 2 shows the engine of FIG. 1 in a longitudinal section.

In FIG. 1, the two rocking pistons 2 and 3 are rigidly mounted on the rocking piston shaft 1 so that the shaft and the pistons constitute a common working part which is internally cooled by means of a cooling oil circuit. The rocking piston shaft 1 is axially journaled at its two extremities in two covers 36 and 37, as seen in FIG. 2. On the rocking piston shaft 1, FIG. 2, the power arm 12 is fixedly mounted at a predetermined angle on the exterior of cover 36, and this arm is also diagrammatically indicated in FIG. 1. The power arm pin f is rotatably coupled to one extremity of a connecting rod 13 whose other end is coupled to the crank pin h of the crank shaft 34, as seen in FIG. 1 and FIG. 2.

At the end of the working stroke, the rocking piston 2 has its radial control edge d flush with the lower control edge E of the by-pass channel 10, while the rocking piston 3 is at the end of its compression stroke, where the ignition is started in the combustion chamber 42 by means of the spark plug 17, so that the working stroke of the piston may begin. At the same time the fresh air taken in continues to flow into the pump chamber 27 on the back side 32 of the rocking piston 3 from the inlet passageway 9 of the hollow rotary slide 5 over its through-flow slot 8 and the control slot 7 of the hollow cylindrical pump chamber-separation element 4, while the control slot 6 of the hollow cylindrical pump chamber-separation element is still covered by the hollow rotatable slide 5. If the crank pin h of the crank shaft 34 rotates from the lower dead center point in the direction of the arrow to the upper dead center point 9 the by-pass slot ED is first closed by the rocking piston 2, and thereafter the exhaust slot CB is covered. At point B the fuel injection begins by means of the injection nozzle 14 and at the same time the compression starts in the work chamber 39 by means of the rocking piston 2 along the circular arc BA, and at the end of the compression the ignition is realized by the spark plug 16. During the compression and upward stroke of the rocking piston 2 the hollow rotary slide 5 moves simultaneously in the direction of the arrow so that the through-flow slot 8 becomes aligned with the control slot 6 of the cylindrical hollow pump chamber-separating element 4, so that the rotary slide 5 covers the control slot 7, and fresh air is drawn into the pump chamber by means of the back side 33 of the rocking piston 2, while at the same time in the pump chamber 27 the air is precompressed by the rocking piston 3 during its return stroke until the control edge d of the rocking piston 3 uncovers first the exhaust slot BC of the work chamber 40 and then the by-pass slot DE of the by-pass channel 11, so that the air that is precompressed in the pump chamber 27 flows into the work chamber 40 and scavenges the latter free of exhaust gases, and the working cycles of both the pump chambers and the work chambers are repeated in continuous sequence. Thus during a rotation of the crank shaft by 360° two work strokes are performed, which corresponds to the number of work strokes of a four-cylinder, four-stroke motor. The two work chambers 39 and 40, the two pump chambers 26 and 27, and the hollow, cylindrical pump chamber-separation element 4 with the hollow rotary slide 5 oscillating without friction therein are surrounded partly concentrically by the two housing segments 19 and 20 while the work chambers 39 and 40 are hermetically separated and sealed relative to each other at the top by means of the angular chamber head 18, in which the combustion chambers 41 and 42 are disposed. The housing segments 19 and 20, the chamber head 8, the two work chambers 39 and 40, and also the pump chambers 26 and 27 are hermetically closed on both sides by the covers 36 and 37, as shown in FIG. 2.

Additional reference characters have the following significance:

F is the point of contact of the gas forces on the centroid S of the rocking piston work surfaces.

23 is the effective power arm between the point of contact of the force and the pivot point *m* of the rocking piston shaft 1.

*f* is the end position of the power arm pin *f* at the lower dead center point of the crank pin *h* of crank shaft 34.

*e* is the end position of the power arm pin *f* at the upper dead center point g of the crank pin *h* of crank shaft 34.

24 and 25 are the axially extending front sealing bars associated with the inner circular surfaces of the housing segments 19 and 20.

30 and 31 are the sealing bars extending on both sides of the rocking pistons 2 and 3 radially from the outer diameter of the rocking piston shaft 1.

*r* are the axial sealing rings of the rocking piston shaft 1, FIG. 2.

35 is the cover housing with the bearing for the crank shaft 34 and support bearing for the rocking piston shaft 1 with the gear flange.

36 is the one-piece planar cover housing (rear side) with the bearings for the rocking piston shaft 1, the hollow rotary slide 5 and the crank shaft 34.

37 is the one-piece planar cover housing (front side) with the bearings for the rocking piston shaft 1, the hollow rotary slide 5 and the crank shaft 34.

38 is the cover housing with the bearings for the hollow rotary slide 5 and the crank shaft 34.

41 and 42 are the sphere-shaped combustion chambers.

43 is the crank case.

In addition, sealing bars *i* which extend axially are arranged concentrically in the chamber head 18 and are inwardly directed to provide a seal between the chamber head 18 and the rocking piston shaft 1. Furthermore, a sealing bar *k* is arranged conversely in the hollow cylindrical pump chamber-separation element 4.

What is claimed is:

1. A two-chamber, two-stroke rocking piston internal combustion engine comprising:

a. a housing having a cavity therein;

b. two rocking pistons directly mounted on a common shaft in said housing cavity, each of said rocking pistons having a forward side delimiting a work chamber and a back side delimiting a pump chamber, each of said pistons being movable through a work stroke and a compression stroke, precompression of fresh air taking place in said pump chamber as each piston moves through its work stroke;

c. a hollow, cylindrical, stationary separation element located between the two pump chambers, said separation element having control slots therein;

d. a hollow, rotatable slide mounted in said separation element and having an internal fresh air intake channel and a through flow slot for cooperation with said control slots in the separation element to positively control admission of fresh air into the two pump chambers and also positively control precompression thereof in said two pump chambers;

e. by-pass channels formed in said housing and extending between each pump chamber and the associated work chamber;

f. means connecting each by-pass channel for communication with one pump chamber and the associated work chamber so as to permit scavenging and recharging of such work chamber by precompressed fresh air from the pump chamber when the piston delimiting such chambers reaches a position wherein there is fluid flow communication between such pump chamber and the work chamber;

g. means, coupled with the engine, for supplying fuel thereto; and h. ignition means associated with each work chamber.

2. A two-chamber, two-stroke rocking piston internal combustion engine according to claim 1, wherein said connecting means of each by-pass channel includes a first by-pass slot by which such by-pass channel communicates with the pump chamber and a second by-pass slot by which such by-pass channel communicates with the associated work chamber, each rocking piston co-operating with the first and second by-pass slots to open and close said by-pass slots as the piston moves through its work and compression strokes, said first and second openings being spaced apart such that both are opened by the piston when it is near the end of its work stroke to effect recharging of the associated work chamber by precompressed air from the pump chamber.

3. A two-chamber, two-stroke rocking piston internal combustion engine according to claim 2, wherein said second by-pass slot has upper and lower control edges, said forward side of each piston being flush with the lower control edge of the second by-pass slot when such piston is at the end of its work stroke.

4. A two-chamber, two-stroke rocking piston internal combustion engine according to claim 2, including an exhaust channel associated with each work chamber, each exhaust channel having an exhaust slot by which such exhaust channel communicates with said exhaust channel, each rocking piston co-operating with the exhaust slot to open and close said exhaust slot as such piston moves through its work and compression strokes, said exhaust slot being spaced from said first and second by-pass slots such that said exhaust slot is completely opened by said piston prior to the opening of both said first and second by-pass slots when the piston is near the end of its work stroke.

5. A two-chamber, two-stroke rocking piston internal combustion engine according to claim 4, wherein said housing includes:

a. a pair of housing segments, said pump chambers, work chambers, and hollow cylindrical separation element being enclosed by said housing segments, said exhaust channels, exhaust slots, by-pass channels, and first and second by-pass slots being disposed in said housing segments, said housing segments having upper and lower ends;

b. a chamber head disposed in the rocking piston plane between said housing segments and symmetrically engaging said upper ends of said housing segments, said chamber head hermetically separating said work chambers; and c. cover housings connected with said housing segments and effecting sealing of said pump chambers and said work chambers on both axial sides of pistons in planes corresponding with planes of movement of said pistons.

6. A two-chamber, two-stroke rocking piston internal combustion engine according to claim 1, wherein said hollow cylindrical separation element has inner and outer surfaces both of which have generally cylindrical configurations, said back side of each rocking piston having a surface with the configuration of a truncated cylinder, said truncated cylindrical surface corresponding approximately with part of the outer cylindrical surface of said cylindrical separation element.

7. A two-chamber, two-stroke rocking piston internal combusion engine according to claim 1, wherein only a single cylindrical, stationary separation element is disposed in said housing.

* * * * *